US005946737A

United States Patent [19]

Fleege

[11] Patent Number: 5,946,737

[45] Date of Patent: Sep. 7, 1999

[54] COMBINED ELBOW AND FOOT PROTECTOR

[76] Inventor: Robert Fleege, 130 C South Park, San Francisco, Calif. 94107

[21] Appl. No.: 08/650,435

[22] Filed: May 20, 1996

[51] Int. Cl.[6] ..... A41D 13/00; A43B 3/10

[52] U.S. Cl. ..... 2/455; 2/16; 2/22; 36/7.6; 36/11.5

[58] Field of Search ..... 2/455, 22, 24, 2/16; 602/20, 23; 36/7.5, 7.6, 11, 11.5, 7.1 R

[56] References Cited

U.S. PATENT DOCUMENTS

| | | | |
|---|---|---|---|
| 1,681,548 | 8/1928 | Marcus | 36/11.5 |
| 2,685,141 | 8/1954 | Davenport | 36/7.6 |
| 3,508,544 | 4/1970 | Moore et al. | 2/24 |
| 3,584,402 | 6/1971 | Silverman | 36/7.5 |
| 4,059,910 | 11/1977 | Bryden et al. | 36/11.5 |
| 4,693,019 | 9/1987 | Kim | 36/7.1 |
| 4,730,610 | 3/1988 | Graebe | 128/149 |
| 5,052,128 | 10/1991 | Lonardo | 36/110 |

FOREIGN PATENT DOCUMENTS

| | | | |
|---|---|---|---|
| 975471 | 11/1998 | France | 36/11.5 |
| 14353 | 5/1904 | United Kingdom | 36/7.5 |

*Primary Examiner*—Bibhu Mohanty
*Attorney, Agent, or Firm*—Fulwider Patton Lee & Utecht, LLP

[57] ABSTRACT

A combined elbow and foot protector comprising strapping members (22, 24) for strapping of the protector to the body of the user, and a sole (10) attached to a flexible base (8). The sole (10) comprises at least two rigid sections (12, 14, 16) connected to each other by a flexible joining member (20) adapted to allow the sole to be easily bent until a front section (12) and a heel section (16) form a substantial angle with each other. The protector can be used either as a shoe strapped to the foot of the user, or as an elbow or knee protector strapped to the arm or leg of the user.

14 Claims, 4 Drawing Sheets

COMBINED ELBOW AND FOOT PROTECTOR

BACKGROUND—FIELD OF INVENTION

This invention relates to recreational roller and in-line skating, specifically to a device which can be used by skaters for walking and which also can be used as elbow or knee protection for added safety while skating.

BACKGROUND—DISCUSSION OF PRIOR ART

One of the main problems and frustrations that in-line and roller skaters face is that they are often not able to enter public buildings and other places, when they are wearing skates. Such places as office buildings, restaurants, banks, shops, gyms, certain bridges, museums etc., require proper footwear for safety and liability reasons. A skater on skates is considered a danger to other people and to themselves. Furthermore, the skates can cause damage to furniture, and their wheels may leave marks on floors and carpets. Consequently, skaters cannot combine a skating trip with other activities, without carrying a pair of shoes to change into, before entering above mentioned places. To transport a pair of shoes while skating causes great inconvenience, as this usually requires that the skater carries along a bag or a backpack for this purpose.

There are several different carrying products available. Even though these bags and packs are specifically designed for the in-line skater, they can only make it easier to carry a pair of shoes and thus don't satisfactorily solve the present problem. However, different solutions of varying success has been provided through a few new products. One "solution" is various skate/wheel protectors. These skate/wheel protectors comes in different shapes and forms, all with the same basic idea—to cover and/or to lock the wheels of the skates.

For example, since 1994 Blox International of Toronto, Canada, sells a rubber "pocket" for in-line wheels. The rubber pockets prevent the skates from damaging floors, but mobility while wearing these is very restricted and they can't be used comfortably for more than a short period. A variation of Blox protector is sold under the trademark Streetstriders by Hot Lines, Inc. of Portland, Oreg. The Streetstrider protector is a cover of flexible material for the skates.

U.S. Pat. No. 5,303,955 of Zurnamer shows a similar in-line skate guard.

U.S. Pat. No. 5,236,224 of Anderson shows a walker attachment for in-line skates. The walker attachment prevents the wheels from rolling and does not cover the whole set of wheels which makes it smaller than other skate/wheel protectors.

The problem with all skate/wheel protectors is that it is very awkward and uncomfortable to walk around on skates, which makes these products merely a temporary solution. They therefore solve the described problem only half-way, by giving access to the mentioned places without good and comfortable mobility. Furthermore, these protectors need to be carried somehow by the skater while skating, which is a problem since many of the protectors aren't very small.

U.S. Pat No. 5,331,752 of Johnson shows an in-line skate with a detachable inner shoe which can be used for walking. The skate was manufactured by Rollerblade, Inc. of Minnetonka, Minn. but not sold successfully and the model has since been discontinued.

Thus, the need remains for a product that enables skaters to enter public buildings, and other restricted areas without the inconvenience and drawbacks of having to carry a separate pair of shoes or some other skate protector. The need further exists for a product that provides a skater with a pair of shoes for comfortable walking.

OBJECTS AND ADVANTAGES

The main object of the present invention is to fully solve the above-described problem by providing a skater with a device that enables the skater to enter public buildings and other restricted areas before, after, and in the middle of a skating trip, yet which can be carried by the skater while skating without causing any inconvenience.

Another object of the present invention is to provide a multipurpose piece of equipment, which will grant freedom, flexibility, and improved safety for the skater.

A further object is to provide a skater with emergency footwear which will provide great relief in case of a breakdown of the skates, or in case of an injury, or a condition that prevents the skater from continuing skating.

An additional advantage of the invention is that it makes it possible for the skater to always carry a pair of shoes without having to carry a bag or backpack, which can be uncomfortable, inconvenient, and even dangerous.

A further advantage of the present invention is to provide a device which enables skating to become a way of transportation, for commuting, for instance.

Yet further, a significant advantage is to provide the skater with an additional and a practical reason to wear elbow or knee protectors, which will result in safer skating, due to more frequent usage of effective protection.

Still further objects and advantages of the present invention will become apparent from a consideration of the ensuing description and drawings.

REFERENCE NUMERALS

Figure 1:
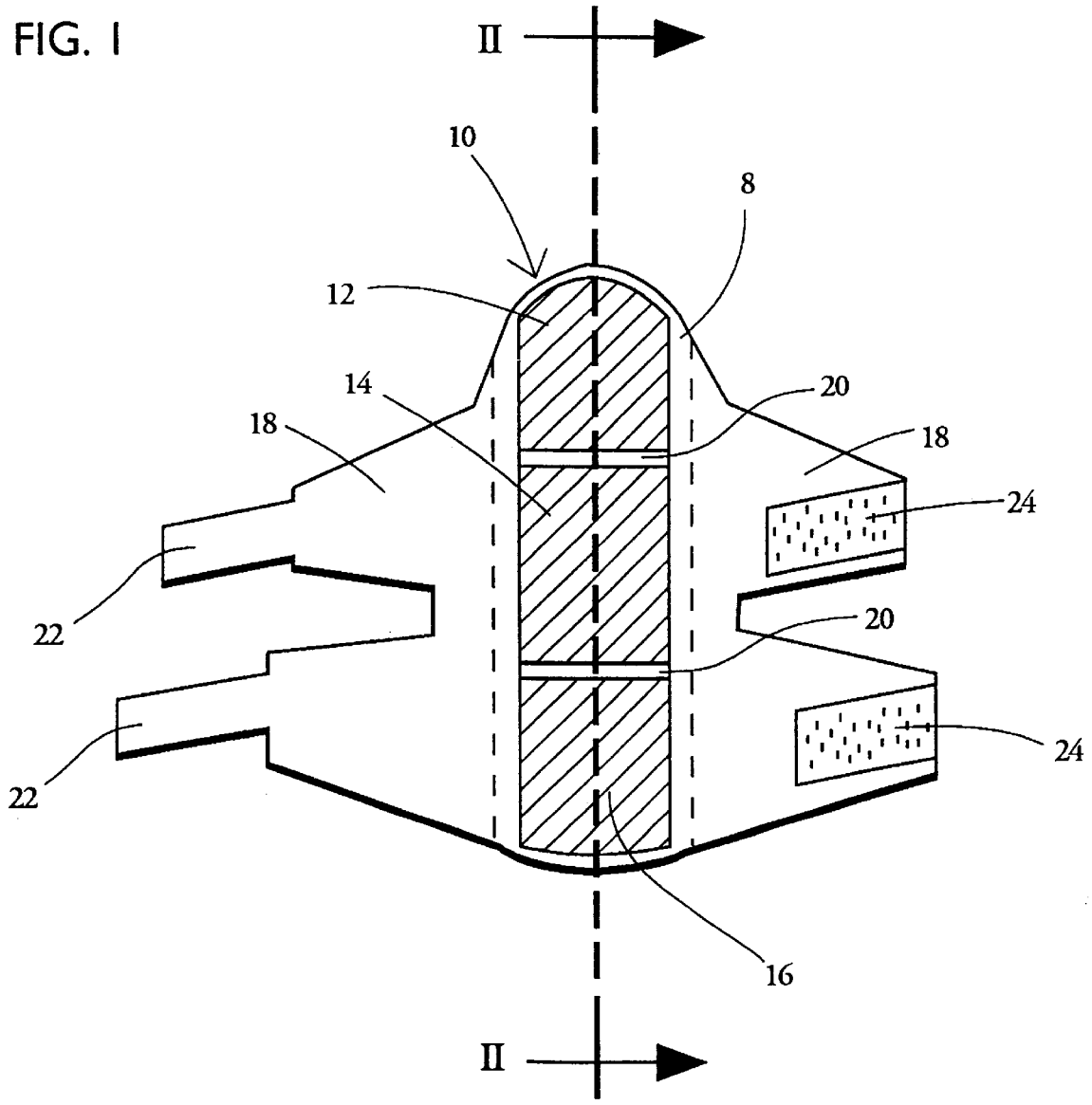
FIG. 1 is a bottom view and illustrates a first preferred embodiment of a combined elbow and foot protector according to the present invention.

8 base
10 sole
12 front section of sole
14 middle section of sole
16 heel section of sole
18 side sections
20 flexible joints
22 straps
24 fasteners
26 foot pocket
28 elbow padding/inside sole

Detailed Description of Preferred Embodiments—FIG. 1

FIG. 1 illustrates from below (in other words, the bottom side) a first preferred embodiment of a combined elbow and foot protector according to the present invention. The protector has a base 8 of flexible, strong, dirt resistant material that can be easily and repeatedly bent, such as nylon, leather, suede leather, synthetic leather, etc. Base 8 is approximately shaped like the sole of a foot with side sections 18 extending outwards from each side. Side sections 18 can be of the same flexible material as base 8, or of stretchable material such as neoprene which makes it possible to wrap side sections 18 around the body part the user wishes to strap the protector onto. A segmented sole 10 is attached on the outer side of base 8 and consists of preferably three rigid sections; a front section 12, a middle section 14, and a heel section 16. Sections 12, 14, and 16 can be rectangular, approximately 10 mm thick and made of rubber or similar energy absorbing material. These sections are positioned one after the other in a linear manner with a minimal gap in between sections. The width and combined length of sections 12, 14, and 16 including the gap in between is approximately the same as the user's foot. Base 8 connects the sole sections and forms a pair of flexible joints 20, allowing the protector to be easily bent until front section 12 and heel section 16 form a substantial angle with each other. The angle should preferably be at least 90° in order not to restrict the movement of the skater's arm while the protector is used as an elbow protector. Furthermore, the protector must freely stay bent and as easily straighten out again in response to the movement of the skater's arm.

The strapping of the protector to the user is accomplished by a pair of straps 22 which on their outer ends comprise fastening means which are designed to mate with a pair of fasteners 24 on an opposite side section 18 of the protector. The strapping of the protector to the user can be achieved in several different ways and the actual means can be of any easily attachable and detachable hook-and-loop material, for example, such as that known as VELCRO. The strapping should, however, be adjustable in length so that it will be possible to tighten around slightly varied-sized elbows and feet.

Base 8 and side sections 18 of the protector are made of strong, flexible and dirt-resistant material and are fixed to sole 10, from which they project upwards in order to keep the protector in place and to provide side protection for the foot, elbow, or knee depending upon the usage of the protector.

FIG. 2

Figure 2:
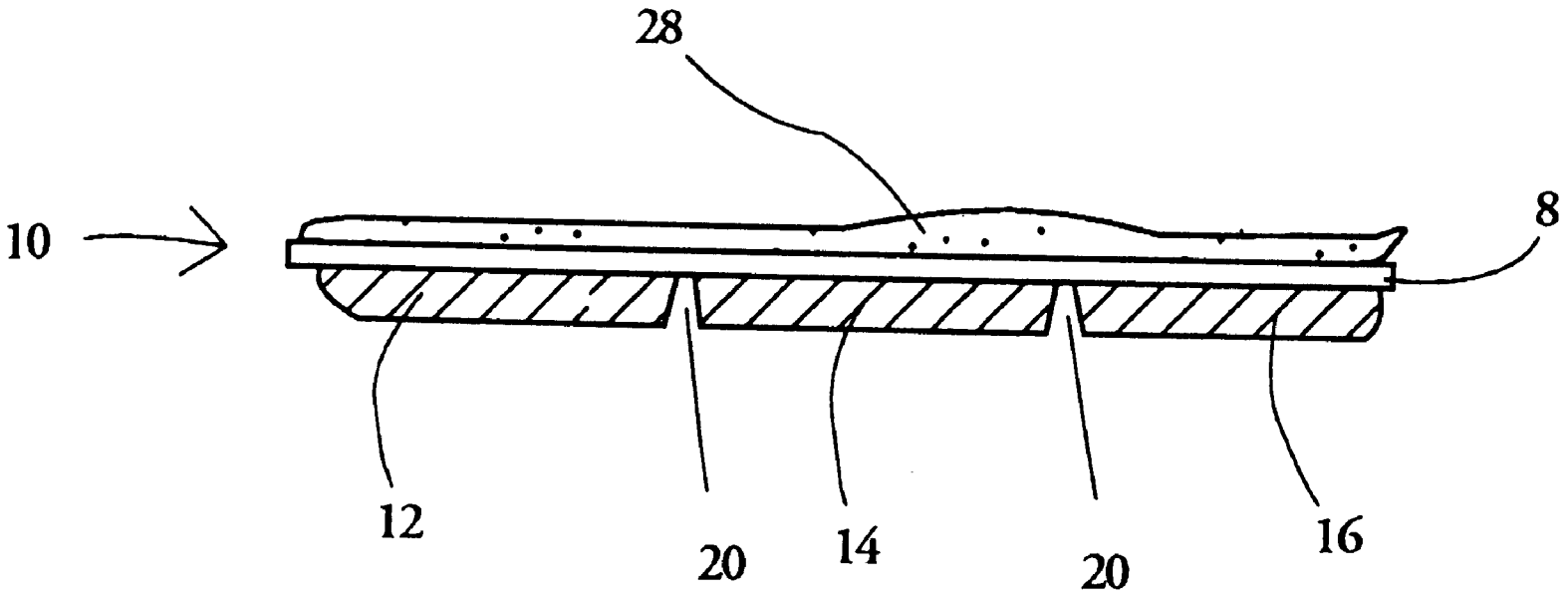
FIG. 2 is a sectional view of the protector in FIG. 1 along dotted line 11—11.

FIG. 2 is a sectional view of the protector in FIG. 1 along dotted line 11—11. FIG. 2 shows how sole 10 comprises three rigid sole sections 12, 14, and 16. Sections 12, 14, and 16 are thick and made of a sturdy and relatively stiff material in order to give the protector the shock absorption needed for walking or for protecting the skater from elbow injuries in case of a fall, while skating. These sole sections are the outer and bottom side of the protector and will make contact with the ground, floors, and sidewalk surfaces when the protector is used for walking. Therefore, it's important that sole sections 12, 14, and 16 are made of a material such as rubber that has a color and/or texture that keeps the protector from appearing wet, dirty, and repulsive.

The protector of FIG. 2 further comprises an elbow padding/inside sole 28 on the upper and inside surface of the sole. Padding 28 is only shown in FIG. 2. The function of padding 28 when the protector is used as elbow protection is to prevent the skater from elbow injury, by absorbing energy in case of a fall. An additional function of padding 28 is to add comfort while skating when the protector is strapped tightly to the arm. When the protector is used as a shoe, padding 28 functions as an inner sole, making the protector comfortable for walking and running. Padding 28 is padded and resilient and of the shape of an insole of a shoe. Further, padding 28 is of light, body-heat resistant material, much like a quality replacement insole for cross trainers, available on the market.

FIG. 3

Figure 3:
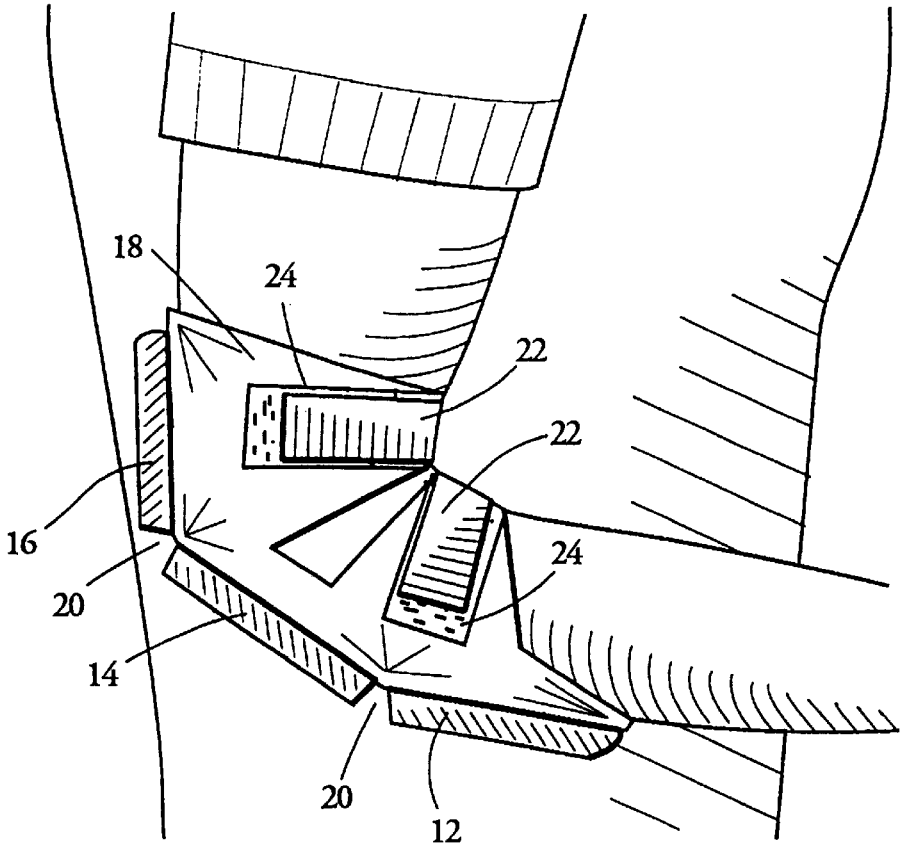
FIG. 3 is a side view of the protector worn as an elbow protector.

FIG. 3 is a side view showing the protector worn as an elbow protector. FIG. 3 clearly illustrates how sole sections 12, 14, and 16 are attached to base 8 and form a pair of flexible joints 20. FIG. 3 shows how flexible joints 20 allow the user to freely bend his or her arm even though the sole of the protector consists of rigid sections. FIG. 3 also illustrates how side sections 18 of the protector provide side protection for the skater as the protector is strapped to the user's arm with straps 22 and fasteners 24. Side sections 18 preferably comprise padding in order to provide additional protection against side-impacts.

Figure 4:
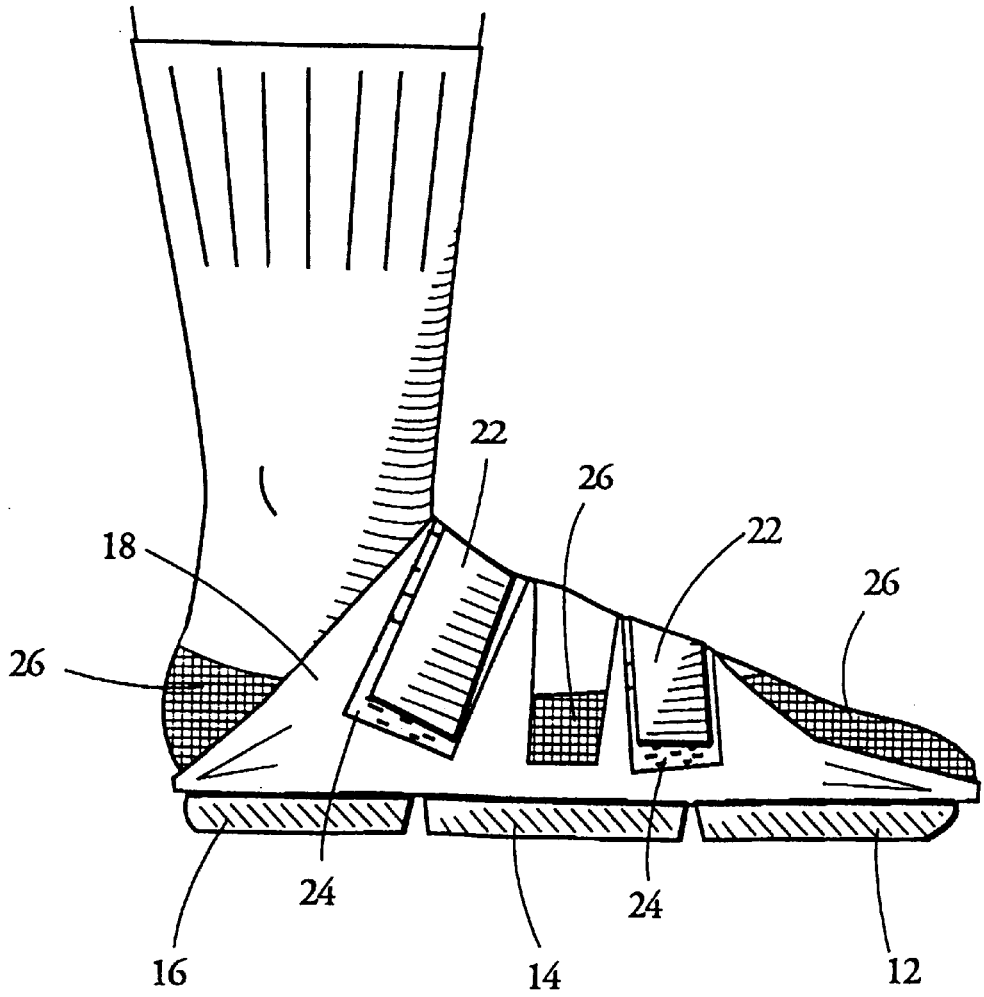
FIG. 4 is a side view of the protector worn as a shoe and illustrates a second preferred embodiment of a protector according to the present invention.

FIG. 4—Second Embodiment of Protector

FIG. 4 illustrates a second preferred embodiment of a protector according to the present invention. The protector of FIG. 4 is very similar with the embodiment of the protector described in connection with FIGS. 1–3. In fact, the only difference is that the protector of FIG. 4 comprises a foot pocket 26 fixed to padding 28. Foot pocket 26 makes the protector more comfortable by keeping the foot in place, which is important for walking and running. Foot pocket 26 is shaped like a foot and preferably made of a light, stretchable, flexible, and breathing material such as polyester, nylon, thin rubber, a net etc., which makes it possible to press or fold foot pocket 26 down closely against the inner surface of padding 28 while the protector is used as an elbow protector.

Operation—FIG. 3

The combined elbow and foot protector is simple to use and its advantages are easy to understand. The protector of FIG. 3 or FIG. 4 is used independently for two purposes, at two different times. For most of the time the protector is used as elbow protection. Prior to skating, the protector is strapped securely to the skater's arm with straps 22 and fasteners 24, as shown in FIG. 3. Hence, the protector fulfills one of its two separate functions, to protect the skater's elbow from injury in case the skater would fall. The protector can also be strapped to another limb such as a knee or a wrist.

FIG. 4

Before, after, or during a skating trip, when the skater, for any of a number of reasons, is in need of footwear, the protector can be worn on the foot as a comfortable shoe, as shown in FIG. 4. First the skater removes the protector from the arm and takes off his or her skates. Then the skater slips the foot into foot pocket 26, inside the protector. After the foot is placed in foot pocket 26, straps 22 are securely wrapped around the foot to mate with fasteners 24 on the opposite side. Now the protector completes its second and more important function; to provide the skater with shoes for unrestricted access and mobility.

Conclusion, Ramifications, And Scope

Thus, the reader will see that the combined elbow and foot protector gives the skater long-craved freedom and access to all public places, thereby taking in-line and roller skating to a new level of recreation. In addition, the protector adds much-needed protection for the skater. The simplicity of the protector makes it very inexpensive to manufacture, therefore making it an awaited and possibly a profitable addition to the in-line accessory market. The combined elbow and foot protector, its function, and its usefulness can be easily grasped by a skater which will ease the introduction and marketing of this novelty in a crowded marketplace.

While my above description contains many specificities, these should not be construed as limitations on the scope of the invention, but rather as an exemplification of one preferred embodiment thereof. Many other variations are possible. For example, the elbow protector can be strapped to another limb such as a knee or a wrist, as well as to a foot. All descriptions of materials, shapes, and sizes can be varied. The sole can be one piece or of several pieces, as long as it is thick enough for good protection and bends freely. The fastening and the closure of the protector can be achieved by several methods. One set of fasteners and straps can be eliminated by widening the other set. The straps and the sides can be made of stretchable material. Instead of directly crossing over the foot, one pair of side sections and straps can cross behind the heel for support. One sole section, preferably the heel section can be of a concave shape for added side support and better fit for an elbow or heel. The foot pocket can be eliminated completely or replaced by a heel pocket and a small toe pocket. Protectors of varied styles and colors may be manufactured to provide for differences in personal tastes and sizes.

Accordingly, the scope of the invention should be determined not by the embodiments illustrated and described, but by the appended claims and their legal equivalents.

I claim:

1. A multipurpose protector, comprising:

a flexible base connected to a pair of side sections at opposite sides of the base, first and second adjustable straps attached to said side sections for strapping said protector to a body part of the user, said straps being spaced apart from each other by a distance selected to allow the flexible base to be mounted about a jointed part of a person and allowing the base to be bent at a substantial angle with that jointed part without the first and second straps interfering with each other and to be straightened, and a sole attached to said flexible base, said sole comprising at least two rigid sections formed of energy absorbent material and connected to each other by the flexible base which is adapted to allow said sole to be bent until a front part and a heel part of said sole form a substantial angle with each other and to be straightened for use as a shoe, wherein said protector can be used either as a shoe strapped to the foot of the user, or as an elbow or knee protector strapped to the arm or the leg of the user.

2. A multipurpose protector according to claim 1 wherein said sole can be bent until said front part and said heel part of said sole form an angle of at least 90° with each other.

3. A multipurpose protector according to claim 1 wherein said sole remains freely at said angle and easily straightens out again.

4. A multipurpose protector according to claim 1 wherein said protector comprises a pair of padded side sections extending along at least a part of sides of said sole, said side sections being fixed to said sole and projecting upwards from the upper surface of said sole in order to provide side protection for the foot, elbow, or knee of the user.

5. A multipurpose protector according to claim 1 wherein said protector comprises an elbow padding and inside sole on the upper surface of said sole, whereby said padding prevents the skater from elbow injuries and adding comfort for the user.

6. A multipurpose protector according to claim 1 wherein said protector comprises a foot pocket attached to the inside sole, whereby said foot pocket keeps the user's foot in place when said protector is used as a shoe.

7. A combined elbow or foot protector, comprising:

a sole portion having a length long enough to support the entire length of the foot to be protected, and that can easily be bent at least 90°, and freely stay at said angle and as easily straighten back out, a pair of sides attached to and extending outwardly from said sole portion, each of said sides having an outer edge, a pair of fastening straps, each having two ends, one of which extends from the edge of one side, said straps being spaced apart from each other by a distance selected to allow the sole portion to be mounted about a joint of a person and allowing the sole portion to be bent at a substantial angle at that joint without the fastening straps interfering with each other and to be straightened, each of said straps being arranged to be tightened and adjustable about a limb and about a foot and removable therefrom, wherein said protector can be used to protect one's elbow, knee, wrist, or one's foot.

8. The protector of claim 7 wherein said straps each comprises a separable and reattachable connector.

9. The protector of claim 7 wherein said connector comprises a hook-and-loop fastener.

10. The protector of claim 7 wherein said protector comprises a foot pocket, said foot pocket keeps the foot comfortably in place when the protector is strapped to the foot.

11. The protector of claim 7 wherein said foot pocket is thin and of light material, whereby said footpocket can be folded flat when said protector is used as a limb protector.

12. A method of protecting a limb joint when skating and a foot when walking, comprising:

disposing a plurality of energy absorbent, rigid segments on the bottom of an elongated sole portion having a pair of opposite sides and a pair of side portions extending out from said respective sides of said sole portion, disposing attachment straps to a side portion and spacing said straps apart from each other by a distance selected to allow the sole portion to be mounted about a joint of a person such that the sole portion may be bent at a substantial angle at that joint without the fastening straps interfering with each other and may be straightened, disposing padding on said sole portion so that it can protect a joint of a limb or the sole of a foot, attaching said protector around the joint of a limb when skating by wrapping said sole portion and said side portions of said protector around said joint and attaching each of said straps to hold the sole portion in place, and attaching said protector around a foot when walking by disposing said sole portion under the foot and wrapping said side portions of said protector around said foot and attaching each of said straps to hold the sole in position under the foot, wherein a skater can use said protector to protect a limb joint when skating and as a shoe to protect a foot when walking.

13. The method of claim 12 Wherein said sole portion comprises a flexible base and plurality of segments attached to said base.

14. The method of claim 12 wherein said straps have hook-and-loop fasteners thereon.

* * * * *